US006217424B1

(12) United States Patent
Stephens

(10) Patent No.: US 6,217,424 B1
(45) Date of Patent: Apr. 17, 2001

(54) METAL-POLISHING TECHNIQUE

(75) Inventor: Ralph M. Stephens, Tampa, FL (US)

(73) Assignee: Custom Metal Polishing Systems Inc., Tampa, FL (US)

( * ) Notice: Subject to any disclaimer, the term of this patent is extended or adjusted under 35 U.S.C. 154(b) by 0 days.

(21) Appl. No.: 08/923,224

(22) Filed: Sep. 4, 1997

(51) Int. Cl.[7] ..... B24B 27/04
(52) U.S. Cl. ..... 451/254; 451/363
(58) Field of Search ..... 451/246, 242, 451/254, 258, 295, 363, 108, 59, 249, 360, 178

(56) References Cited

U.S. PATENT DOCUMENTS

| | | | | |
|---|---|---|---|---|
| 279,001 | * | 6/1883 | Morris . | |
| 932,603 | * | 8/1909 | Davis et al. | 451/254 |
| 952,866 | * | 3/1910 | Baumgardner | 451/360 |
| 985,412 | * | 2/1911 | Hattersley et al. . | |
| 2,077,693 | * | 4/1937 | Herrero | 451/295 |
| 2,150,462 | * | 3/1939 | Schultz et al. | 91/13 |
| 2,386,649 | * | 10/1945 | Belcourt | 451/363 |
| 2,911,764 | * | 11/1959 | Steggeman | 51/106 |
| 3,137,976 | * | 6/1964 | Cooper | 451/254 |
| 4,009,499 | * | 3/1977 | Casler et al. | 15/21 |
| 4,426,747 | * | 1/1984 | Mola et al. | 15/21 |
| 4,532,665 | * | 8/1985 | Evans et al. | 15/21 |
| 5,161,281 | * | 11/1992 | Hanen | 15/88.3 |
| 5,175,900 | * | 1/1993 | Hadgis | 15/97.1 |

* cited by examiner

*Primary Examiner*—Robert A. Rose
(74) *Attorney, Agent, or Firm*—Howrey Simon Arnold & White LLP; Stephen H. Cagle; Carter J. White

(57) ABSTRACT

A technique for polishing metal objects such as, for example, those made of aluminum, stainless steel, and brass is described. The technique employs a metal-polishing apparatus which includes a double-jointed arm assembly and a table assembly. The arm assembly includes a brush assembly, a handle, and an actuating device. The double-jointed nature of the arm assembly advantageously allows an operator to effectively polish a detailed and ornate metal object. The table assembly has a frame, a rotatable table-top assembly, and a mechanism for securing the object. The metal object to be polished is placed on the table-top assembly and allowed to rotate with respect to the frame. The technique also relates to the preparation, polishing, and post-polishing methods employed with the metal-polishing apparatus. The present technique enables aluminum, brass, and stainless steel objects to be effectively polished, and therefore refurbished, by removing a significant amount of damage (i.e., scratches) from the metal object.

7 Claims, 7 Drawing Sheets

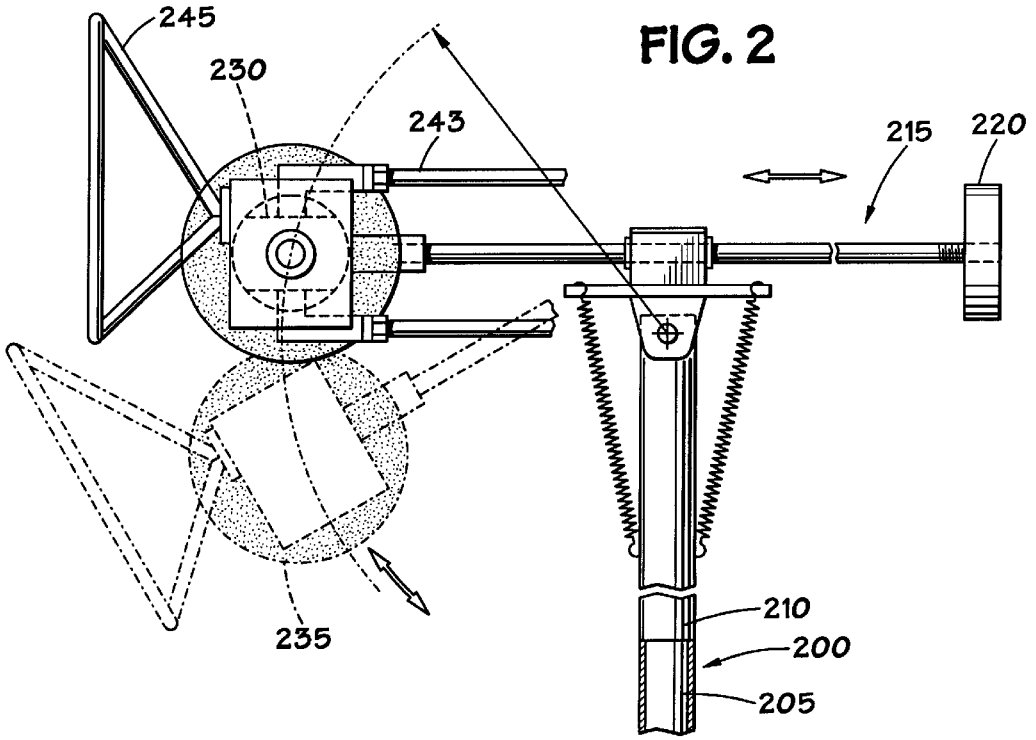
FIG. 2
FIG. 3
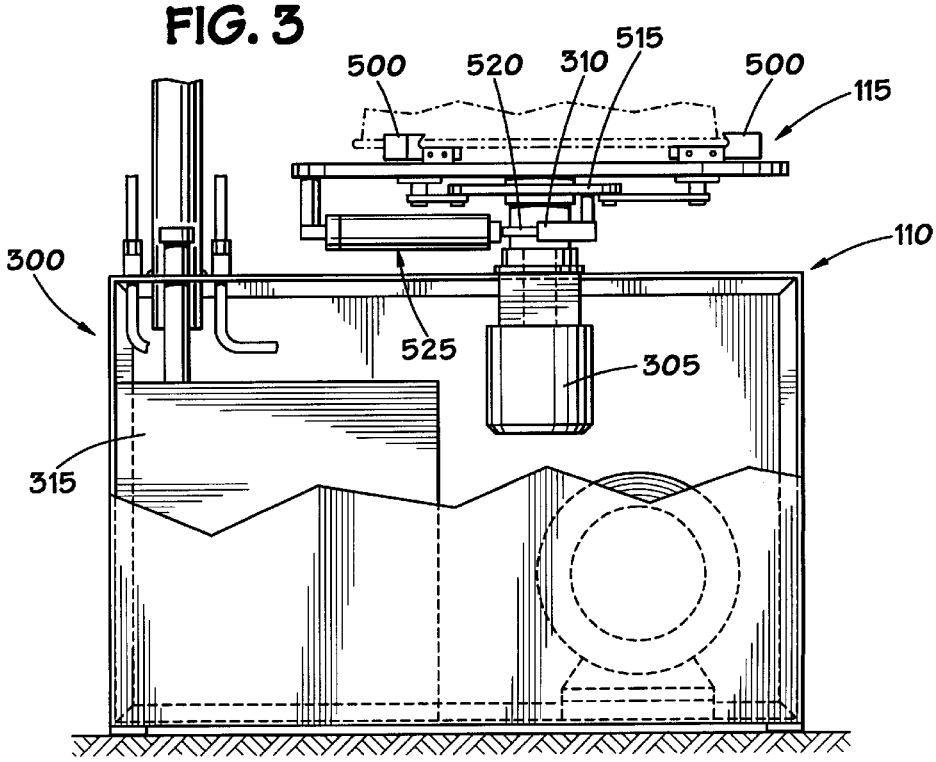

METAL-POLISHING TECHNIQUE

BACKGROUND OF THE INVENTION

The invention relates in general to the field of polishing techniques and, more particularly, to the polishing of metal materials. Specifically, the invention relates to a technique for polishing aluminum, stainless steel, and brass.

Increased metal use and rising costs of metals have caused focus to be placed on the refurbishing of metals through polishing. Generally, conventional metal-polishing techniques do not allow for the capability to effectively polish a detailed and ornate metal object in a consistent fashion because of hard-to-reach comers and insets. Thus, it would be beneficial to have a metal-polishing technique that is capable of overcoming the shortcomings of conventional methods.

SUMMARY OF THE INVENTION

The present invention relates to a technique for polishing metal objects such as, for example, those made of aluminum, stainless steel, and brass. The technique employs a metal-polishing apparatus which includes a double-jointed arm assembly and a table assembly. The arm assembly includes a brush assembly, a handle, and an actuating device. The double-jointed nature of the arm assembly advantageously allows an operator to effectively polish a detailed and ornate metal object. The table assembly has a frame, a rotatable table-top assembly, and a mechanism for securing the metal object. The metal object to be polished is placed on the tabletop assembly and allowed to rotate with respect to the frame. The present invention also relates to the preparation, polishing, and post-polishing methods employed with the metal-polishing apparatus. The present invention enables aluminum, brass, and stainless steel objects to be effectively polished, and therefore refurbished, by removing a significant amount of damage (i.e., scratches) from the metal object.

BRIEF DESCRIPTION OF DRAWINGS

Other objects and advantages of the invention will become apparent upon reading the following detailed description and upon reference to the drawings in which:

FIG. 2 is an enlarged view of the arm assembly of FIG. 1A;

FIG. 3 is an enlarged view of the table assembly of FIG. 1A;

Figure 1A:
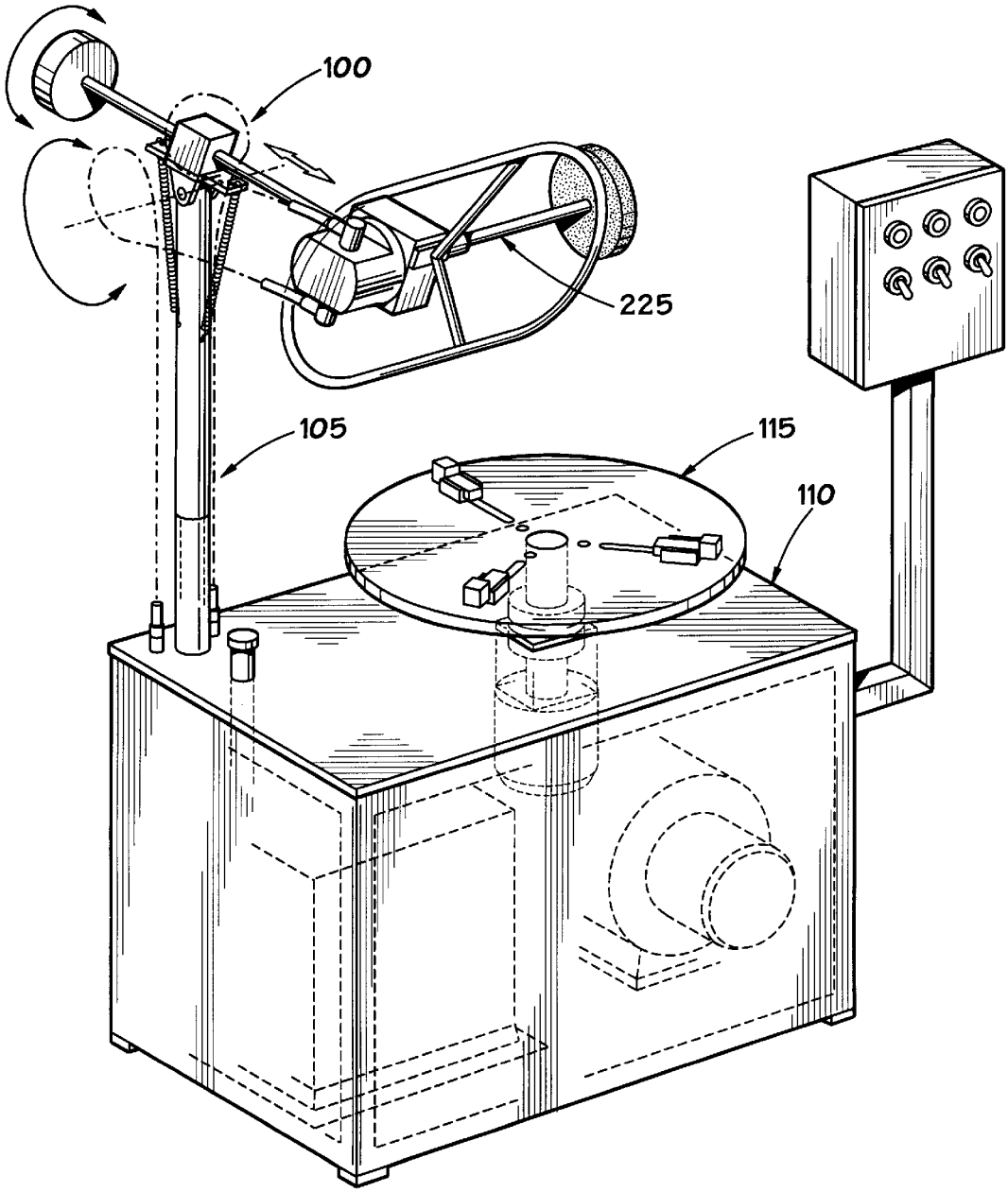
FIG. 1A illustrates one embodiment of the polishing apparatus of the invention.

While the invention is susceptible to various modifications and alternative forms, specific embodiments have been shown by way of example in the drawings and are described in detail. It should be understood, however, that the description herein of specific embodiments is not intended to limit the invention to the particular forms disclosed; on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below as they might be employed in a technique for polishing metals. In the interest of conciseness, not all features of an actual implementation are described in this specification. It will of course be appreciated that in the development of any actual embodiment, numerous implementation-specific decisions must be made to achieve the developer's specific goals, such as compliance with system-related and business-related constraints. Moreover, it will be appreciated that even if such a development effort might be complex and time-consuming, it would nevertheless be a routine undertaking for those of ordinary skill having the benefit of this disclosure.

Overview

Metal objects (such as those made from brass, aluminum, and stainless steel) can be damaged through routine use. For example, an aluminum wheel can become damaged over time by scratches from curbs and rocks and asphalt deposits. The present invention is a polishing technique that enables a significant amount of scratches to be removed from a metal object. FIG. 1A illustrates a polishing apparatus 100 in accordance with the invention that includes a double-jointed arm assembly 105 and a table assembly 110. The double-jointed arm assembly 105 allows manipulation of the arm assembly by an operator (not shown) in multiple directions. The operator can control the angle of a polishing brush attached to the arm assembly to virtually ensure that even small crevices (that would not have been polished with conventional techniques) are effectively polished.

Figure 1B:
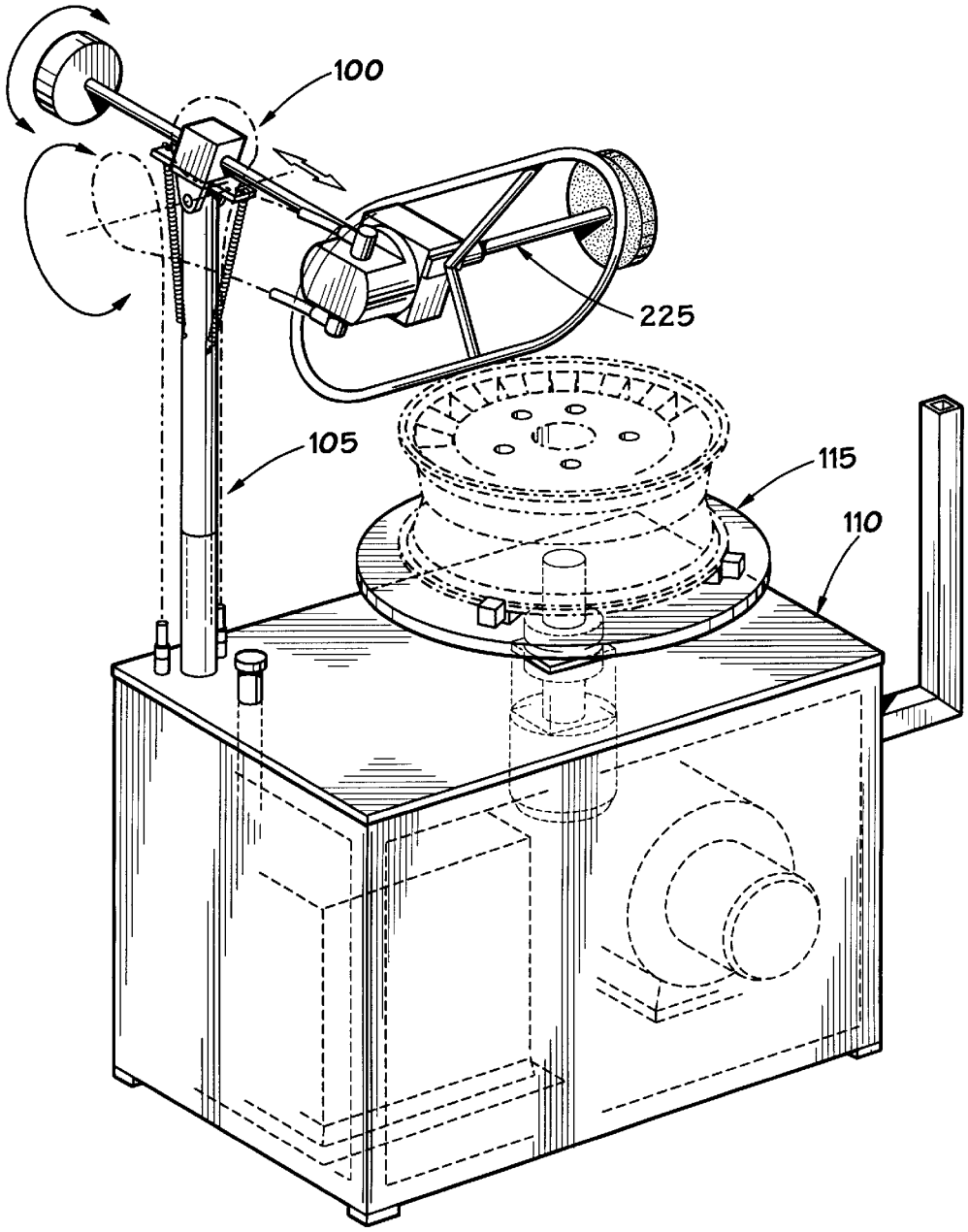
FIG. 1B illustrates the embodiment of FIG. 1A with a metal wheel rim on the apparatus of FIG. 1A.

The metal object is prepared for polishing by removing the outer protective coating and sanding the metal object until it is consistent (i.e., uniformly sanded with the sanding lines in one direction). After the metal object has been prepared for polishing, it is automatically centered and secured on table-top assembly 115 which, in turn, is connected to table assembly 110. Table-top assembly 115 rotates the metal object. A brush attached to arm assembly 105 polishes the metal object while it is rotating. FIG. 1B illustrates the use of polishing apparatus 100 to polish an aluminum wheel rim. When the metal object has been polished, the polishing compound is removed by cleaning the metal object.

Specific Embodiments

FIG. 2 illustrates the double-jointed arm assembly 105 that can be used in a metal-polishing apparatus in accordance with this invention. The arm assembly includes a first rod 200. Rod 200 can be constructed such that it contains two separate pieces: a lower piece 205 which can be fused to a frame assembly (not shown) and an upper piece 210 coupled to rod 205. The use of two pieces for rod 200 enables the arm assembly to be separated from the frame assembly. Rod 200 is typically constructed from a material, such as stainless steel, that provides the rigidity needed to minimize bending.

Rod 215 is rotatably coupled to rod 200 and rod 225 (see FIG. 1B), thereby forming two joints. Rods, 200, 215, and 225 form a double-jointed arm. Joint 226 allows rotation of the arm assembly 105 about a horizontal axis. Joint 227 allows rotation of the arm assembly 105 about a vertical axis. The double-jointed nature of the arm assembly enables the operator to effectively polish the metal object (not shown). The two joints allow horizontal, axial, vertical, and torsional movement such that the operator can polish portions of the metal object that may not have been able to be reached with conventional polishing techniques.

At the end of rod 215 labeled 220, springs (not shown) can be attached to offset the weight of the third rod. Free weights can also be attached to end 220 of rod 215 to further offset the weight. Rods 215 and 225 can be formed from the same material as rod 200. An actuating device 230 is attached to the top end of rod 225 while a brush assembly 235 is attached to the lower end of the rod. Actuating device 230 is also coupled to brush assembly 235 by a connecting device (not shown). The actuating device may be any type of conventional actuating device (e.g., a pneumatic or hydraulic motor).

Brush assembly 235 is typically snapped into a lock position on rod 225. A passage 243 (which is connected to rod 200) provides the power for actuating device 230. Brush assembly 235 rotates when the actuating device 230 is powered. A handle 245 may be attached to rod 225. Vertical movement of handle 245 causes rod 215 to rotate in relation to rod 210. Similarly, angular movement of handle 245 causes rod 225 and brush assembly 235 to rotate in relation to rod 215. Thus, through the use of handle 245, the operator can control the manner in which brush assembly 235 engages the metal to be polished (not shown).

One skilled in the art will realize that the arm assembly of FIG. 2 can be implemented with conventional polishing tables. However, it is also adaptable to a table assembly in accordance with the present invention. FIG. 3 shows a table assembly 110 which includes a table-top assembly 115 and a frame assembly 300. Actuating device 305 within frame assembly 300 is connected to a support member 310 of table-top assembly 115. The actuating device 230 may be any type of conventional actuating device (e.g., a pneumatic or a hydraulic motor). Frame assembly 300 also includes a fluid reservoir 315 coupled to actuating device 305. In embodiments wherein a hydraulic motor is used for the actuating device, the reservoir is a hydraulic fluid tank.

Figure 5A:
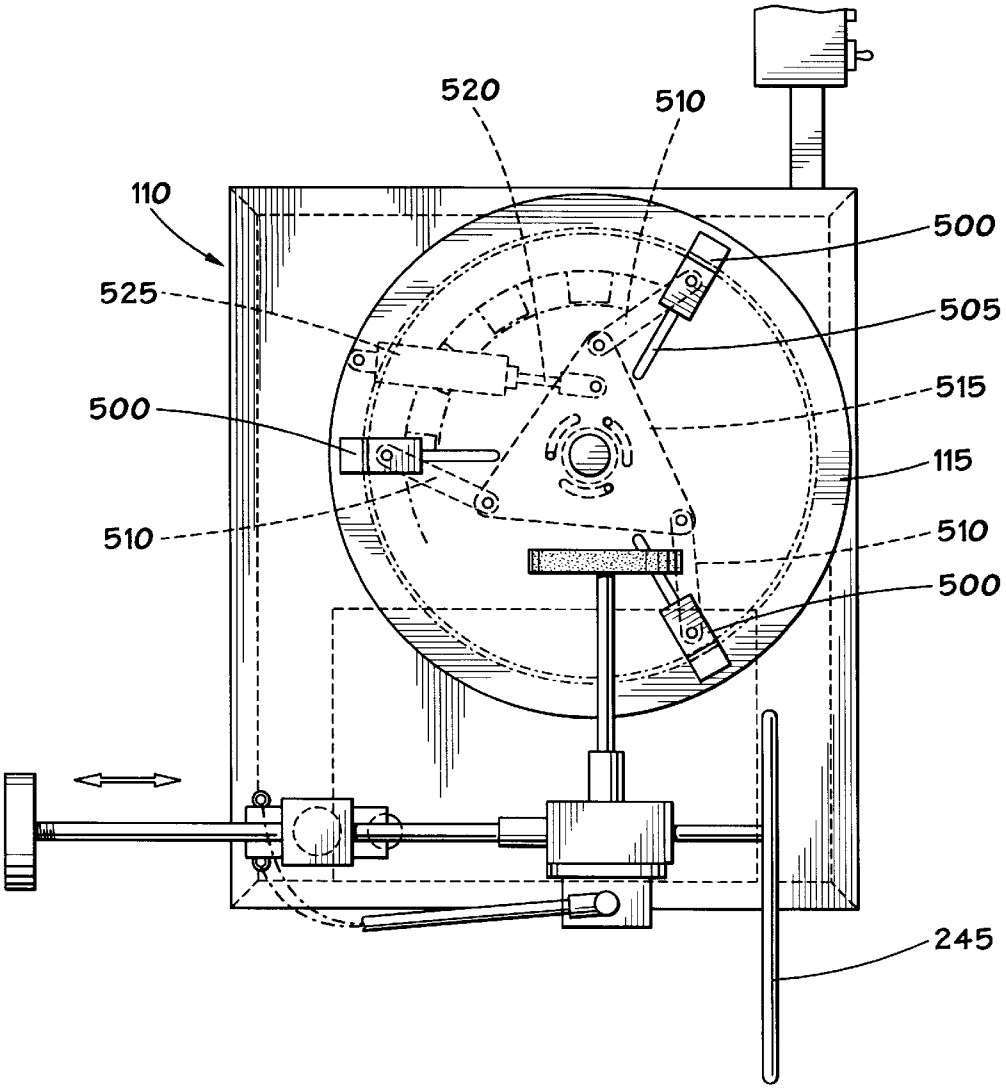
FIGS. 5A and 5B are enlarged views of the table-top assembly of FIG. 3.
Figure 5B:
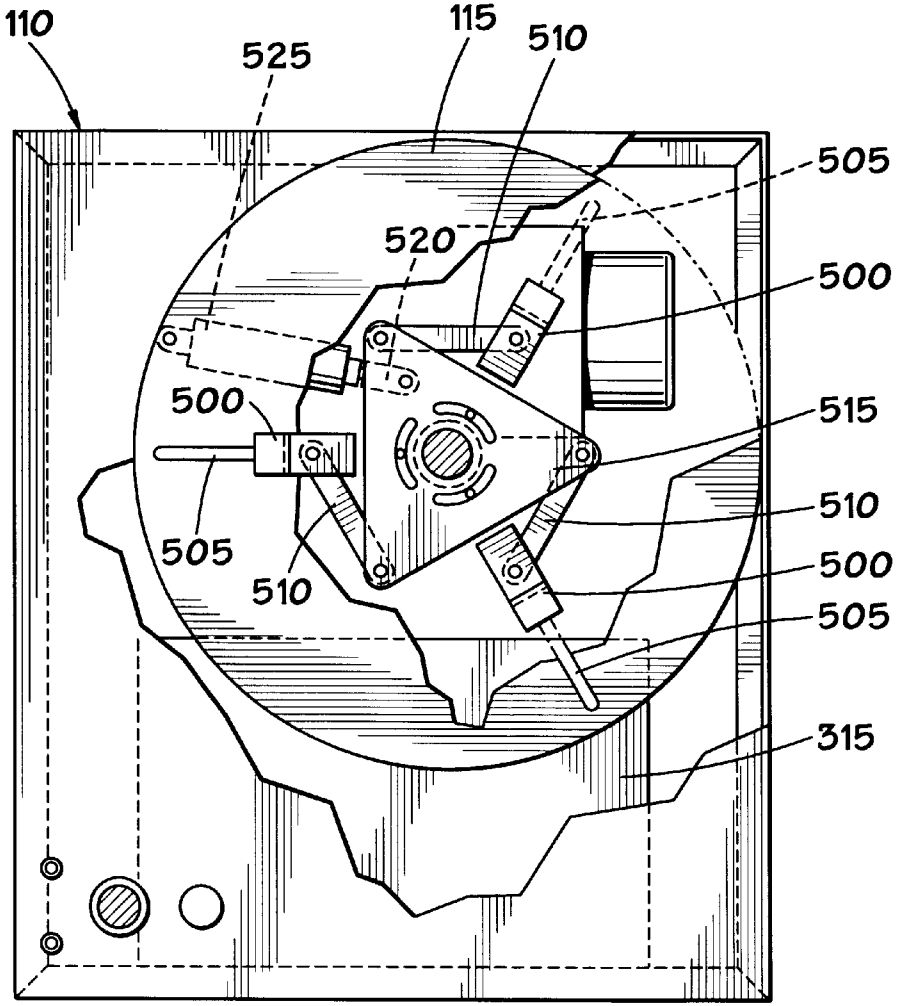
Figure 7:
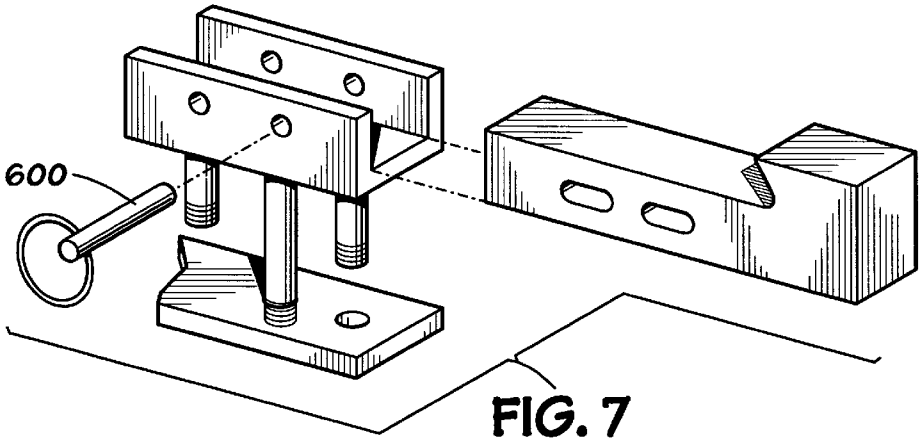
FIGS. 6–7 illustrate clamping mechanisms in accordance with the invention.
Figure 6:
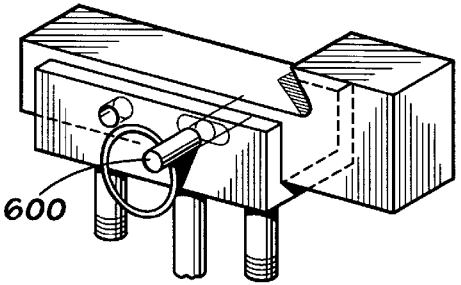

FIGS. 5A and 5B illustrate a top view of table-top assembly 115. Three clamping mechanisms 500 are connected to table-top assembly 115 within orifices 505. FIGS. 6 and 7 illustrate a possible configuration for clamping mechanism 500 in which two cutterpins 600 are used to secure the device. The clamping mechanisms are designed to slide within the orifices to secure the metal object to be polished. For example, if a metal wheel rim mounted to a wheel is being polished, the clamps can be designed to slide to the innermost point of the orifice to allow the rim to be placed on the table. After the rim and wheel are placed on the table, the clamps can be controlled to slide outward evenly until they engage the rim allowing automatic centering and securing of the wheel rim. If a different type of metal object (e.g., a portion of a motorcycle) is to be polished, the clamps can slide inward to secure the object around its outside edge.

FIG. 5A shows a circular plate of the table-top assembly 110. Orifices 505 are shown with clamping mechanisms 500 extended inward. Linking arms 510 are connected to each of the clamping mechanisms so that movement of the linking arms cause each clamping mechanism to be moved from one end of orifice 505 to the other end. The linking arms 510 are also connected to the ends of pivoting device 515 such that movement of the pivoting device causes the linking arms to move. On one side of pivoting device 515, a rod 520 is connected between the pivoting device and an engaging mechanism 525. When engaging mechanism 525 contacts rod 520, pivoting device 515 moves, which causes linking arms 510 to engage the clamping mechanisms 500 as shown in FIG. 5B.

The engaging mechanism 525 may be a conventional engaging mechanism (e.g., a pneumatic or a hydraulic cylinder). The engaging mechanism 525 is also coupled to reservoir 315 which controls when the engaging mechanism 525 contacts rod 520. One of ordinary skill will realize that the spinning of the table-top assembly could be controlled separately from the clamping mechanisms presently described. In addition, the rotation of the brush assembly could also be separately controlled from the rotation of either the pivoting device or the table-top assembly. Despite the independence between the two actuating devices and the engaging mechanism, they may all use reservoir 315. The table-top assembly described can be adapted to fit with a conventional arm assembly or the arm assembly of the present invention.

Figure 4:
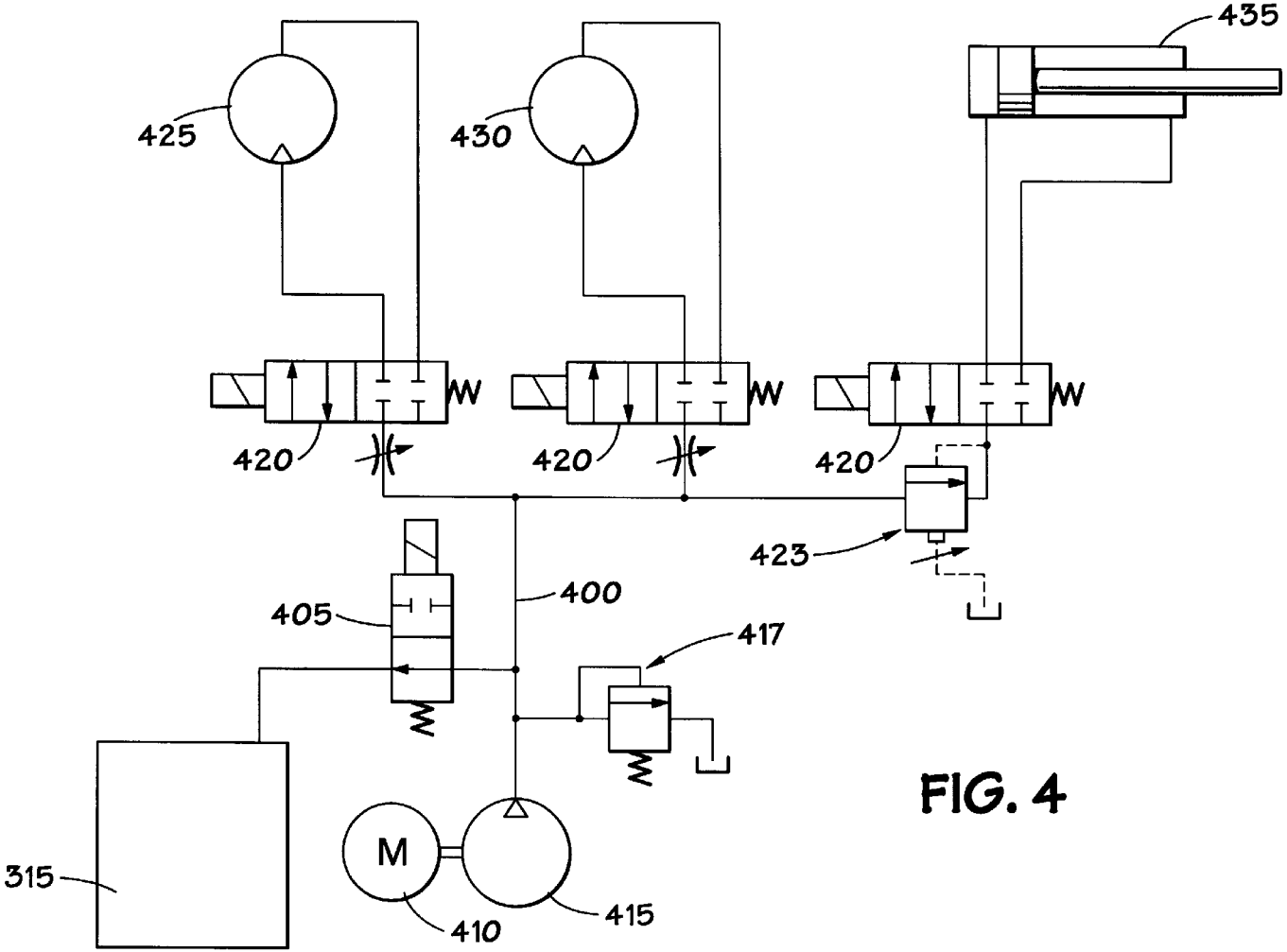
FIG. 4 is a hydraulic schematic that can be used with a polishing apparatus in accordance with the invention.

FIG. 4 is a hydraulic schematic diagram that can be used with a polishing apparatus, in accordance with the invention. Reservoir 315 is connected to a main hydraulic passage 400 through a valve 405. Electric motor 410 is connected to pump 415 which provides the force needed to fill hydraulic passage 400. Relief valve 417 can be used to relieve pressure in hydraulic passage 400 to minimize excessive pressure. Valves 420 are used to couple motor 425, motor 430, and cylinder 435 to hydraulic passage 400. Motor 425 can be a torque motor with approximately 150 rpm and can be used to control the rotation of the table-top assembly 115. Motor 430 could be used to control the rotation of the brush attachment 235 and could be a gear motor with approximately 2000 rpms. A pressure-reducing valve 423 can be used to reduce the pressure in the portion connected to the hydraulic cylinder 435 to minimize the likelihood of damaging the cylinder. Hydraulic cylinder 435 may be used to engage/disengage the clamping mechanism 400 (see below) on the table-top assembly 115. One skilled in the art will appreciate that variations can be made to the schematic without departing from the inventive concept described herein.

Figure 8:
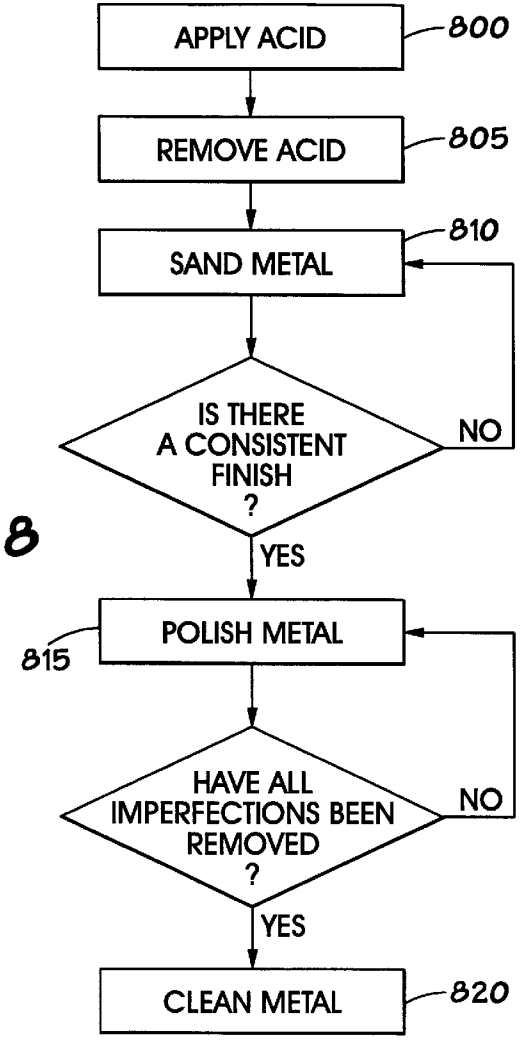
FIG. 8 is a flow chart for the polishing technique of the invention.

The arm assembly and the table assembly in accordance with the invention cooperatively fit together to generate a polishing apparatus that can be used in a metal-polishing technique in accordance with the invention. FIG. 8 is a flow diagram that illustrates this metal-polishing technique. Block 800 is the application of an acid to the metal to be polished. The acid can be used to remove a protective outer coating on the metal, which is typically referred to as stripping the metal. Conventional acids (e.g., TAL Strip II) may be used as a stripper. At block 805, a conventional method may be used to remove the stripper (e.g., pressure hosing). One skilled in the art will understand that the method used to remove the acid depends upon the type of stripper used.

After the metal object has been stripped, it is sanded at block 810 in preparation for polishing the metal. Conventional sanding techniques and tools (e.g., a die grinder and a roll-lock disk) may be used. The number of sandings and coarseness of the sanding tool depend upon the condition of the metal object. For example, a metal object with many deep scratches may need to be sanded several times with sanding objects of varying coarseness. The metal object is sanded until it has a consistent finish (i.e., all of the sanding lines are in the same direction and are uniform). If the finish is not consistent, the sanding step is repeated. Typically, sanding discs may include the following commercial products: coarse: #05528; medium: 05527 and fine: 05523, all manufactured by the 3M Company.

After the metal has a consistent finish, it is placed on polishing apparatus 100. If any portion of the metal has not been sanded, the remaining portion may be sanded while it is on the polishing apparatus. For example, if a metal wheel rim is to be polished, the "lip" of the wheel rim may be sanded once the wheel rim is placed on the polishing apparatus. The number of polishes and the type of brush depend on the condition of the wheel.

A conventional polishing compound may be applied to the metal with the brush attachment. Preferred polishing compounds include model nos. W-100-WD100 by California Buff ("white compound") and CBC-36 by California Buff ("black compound"). If a second polishing compound is desired for a different type of polishing, a different brush may be attached to the brush assembly and the second compound applied to the new brush. For example, the white compound may be applied first, followed by application of the black compound. Preferred polishing brushes include the Sisal Buff brush by California Buff and a Spiral & Concentric Sewed brush, also by California Buff.

After the metal has been polished, the polishing compound is removed with a delicate cleaning compound to prevent scratching (block 820). Lime rock, in the form of a light powder, is applied to the metal to remove any remaining polishing compound. If the lime rock is applied with the hands, the likelihood of the metal object being scratched during cleaning is reduced. When the metal has been cleaned, the process may be repeated with a different metal object It will be appreciated by those of ordinary skill in the art having the benefit of this disclosure that numerous variations from the foregoing illustration will be possible without departing from the inventive concept described therein. Accordingly, it is the claims set forth below, and not merely the foregoing illustration, which are intended to define the exclusive rights of the invention.

What is claimed is:

1. A metal-polishing apparatus comprising:

a) an arm assembly comprising:

i) a first rod having a top end and a bottom end;

ii) a second rod having first and second ends, said top end of said first rod being transversely connected proximate to said first end of said second rod, said second rod rotatable in relation to said first rod;

iii) a third rod having a top end and a bottom end, said second end of said second rod being transversely connected proximate to said top end of said third rod, said third rod rotatable in relation to said second rod;

iv) a first actuating device coupled to said top end of said third rod;

v) a passage coupled to said first rod and said first actuating device;

vi) a handle coupled to said third rod;

vii) a brush assembly transversely connected to said bottom end of said third rod, said brush assembly operatively coupled to said first actuating device;

b) a table assembly, said table assembly comprising:

i) a frame assembly coupled to a second end of said first rod, said frame assembly including a second actuating device coupled to said frame assembly;

ii) a table-top assembly having a lower surface rotatably coupled to said frame assembly and operatively coupled to said second actuating device so that operation of the second actuating device causes the rotation of said table top assembly, said table-top assembly comprising:

a) a circular plate having at least three orifices wherein one slider is coupled to the opening of each orifice;

b) a pivot cam coupled to a top surface of said table plate, said pivot cam having at least three ends;

c) at least three connecting arms coupled to said ends of said pivot cam and said slides, said connecting arms being in contact with said orifices when said pivoting device is in a first position; and d) an engaging mechanism for engaging a rod coupled to said pivot cam wherein engaging of said rod causes said pivot cam to be in said first position.

2. The polishing apparatus of claim 1 wherein said second actuating device is a hydraulic motor.

3. The polishing apparatus of claim 2 further including a hydraulic fluid tank coupled to said frame assembly and connected in fluid communication with said hydraulic motor.

4. The polishing apparatus of claim 3 wherein said engaging mechanism is a hydraulic cylinder.

5. A table assembly for a metal-polishing apparatus comprising:

a) a frame assembly having an upper surface, said frame assembly including an actuating device coupled to said frame assembly;

b) rotatable table-top assembly rotatably coupled to said upper surface of said frame assembly and operatively coupled to said actuating device so that operation of the actuating device causes the rotation of said table top assembly, said table-top assembly comprising:

i) a first plate having at least three orifices wherein a clamping mechanism is coupled to each orifice, said clamping mechanism for securing a metal object to said rotatable table-top;

ii) a second plate having at least three orifices wherein the alignment of said first-plate and said second-plate orifices provides connection of said second-plate orifices with said clamping mechanisms;

iii) a pivoting device coupled to a top surface of said second plate, said pivoting device having at least three ends;

iv) at least three connecting arms wherein each connecting arm is coupled to one of said clamping mechanisms by said orifices in said second plate; and v) an engaging mechanism connected to either said first plate or said second plate, said engaging mechanism including a rod coupled to said pivoting device wherein the engaging of said rod by the engaging mechanism causes said pivoting device to rotate and said connecting arms to move within said second-plate orifices, said engaging device being coupled to said reservoir wherein liquid from said reservoir causes said engaging mechanism to move.

6. The table assembly of claim 5 wherein said actuating device is selected from the group consisting of a hydraulic motor and an electric motor.

7. The table assembly of claim 6 said engaging mechanism is selected from the group consisting of a hydraulic cylinder and a pneumatic cylinder.

* * * * *